US006550397B2

(12) United States Patent
Kawasaki et al.

(10) Patent No.: US 6,550,397 B2
(45) Date of Patent: Apr. 22, 2003

(54) CAR BODY

(75) Inventors: Takeshi Kawasaki, Kudamatsu (JP); Sumio Okuno, Kudamatsu (JP); Toshiaki Makino, Kudamatsu (JP); Kentaro Masai, Kudamatsu (JP); Kazufumi Yamaji, Kumage-gun (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/118,007

(22) Filed: Apr. 9, 2002

(65) Prior Publication Data

US 2002/0108531 A1 Aug. 15, 2002

Related U.S. Application Data

(62) Division of application No. 09/806,128, filed as application No. PCT/JP98/04335 on Sep. 28, 1998, now Pat. No. 6,394,000.

(51) Int. Cl.[7] ..... B61D 17/00

(52) U.S. Cl. ..... 105/401; 105/397; 105/400; 105/399

(58) Field of Search ..... 105/396, 397, 105/399, 400, 355, 409, 401, 407, 411, 329.1; 296/187, 188, 189, 203.01, 203.03, 146.15, 181, 183; 244/119, 125, 126, 129.3

(56) References Cited

U.S. PATENT DOCUMENTS

| | | | | | |
|---|---|---|---|---|---|
| 4,337,708 | A | * | 7/1982 | Peterson | 105/397 |
| 4,725,091 | A | * | 2/1988 | Fujii et al. | 296/201 |
| 4,993,329 | A | | 2/1991 | Takeich et al. | |
| 4,995,321 | A | * | 2/1991 | Ohmura et al. | 105/397 |
| 5,383,406 | A | * | 1/1995 | Vanolo et al. | 105/401 |
| 5,690,035 | A | * | 11/1997 | Hatayama et al. | 105/452 |
| 6,196,136 | B1 | * | 3/2001 | Yoshizaki et al. | 105/396 |
| 6,305,866 | B1 | | 10/2001 | Aota et al. | |
| 6,446,562 | B1 | * | 9/2002 | Ina et al. | 105/413 |

FOREIGN PATENT DOCUMENTS

| | | |
|---|---|---|
| JP | 58-104764 | 7/1983 |
| JP | 61-57072 | 4/1986 |
| JP | 2-246863 | 10/1990 |
| JP | 3-103869 | 10/1991 |
| JP | 6-45341 | 6/1994 |
| JP | 7-257371 | 10/1995 |
| JP | 9-118227 | 5/1997 |

* cited by examiner

*Primary Examiner*—Mark T. Le
(74) *Attorney, Agent, or Firm*—Antonelli, Terry, Stout & Kraus, LLP

(57) ABSTRACT

A car body, in which a hollow shape stock composed of two face plates and ribs joining the face plates together is used to form a side body, and stresses are reduced while minimizing an increase in mass. A car body, comprising a hollow shape stock composed of two face plates (31, 31) and ribs (32) joining the face plates together and used to form a side body (11), wherein face plate portions (31*c*, 31*d*) in regions (B, D) above and below connection points (c) between circular arcs, which constitute corner portions of a window (15), and vertical sides of the window (15) are greater in thickness than in the remaining regions (A, C, E). Stresses are most heavily concentrated in the regions (B, D). Therefore, it is possible to achieve reduction in mass and enhancement in strength together. Further, buckling preventive tools can be arranged in spaces in the regions (B, D) of the hollow shape stock. Further, with the hollow shape stock (18) in a pier panel, face plates on an internal side are greater in thickness than those on an external side.

2 Claims, 14 Drawing Sheets

15: window 30, 30a-30d: hollow shape stock

18: pier panel c, e: connection points

CAR BODY

This application is a Divisional application of application Ser. No. 09/806,128, filed Mar. 27, 2001, now U.S. Pat. No. 6,394,000, which is an application filed under 35 USC 371 of International (PCT) Application No. PCT/JP98/04335, filed Sep. 28, 1998.

FIELD OF THE INVENTION

This invention relates to a car body comprised of extruded stocks, especially to a side body preferable for a rolling stock of a railway car.

DESCRIPTION OF THE RELATED ART

Heretofore, the rolling stock of a railway car, especially the side body thereof, is strongly requested to reduce mass as well as to enhance strength. In order to achieve this contradicting problem, the corner portion of the openings such as windows and the like provided to the side body must be examined from the viewpoint of strength, and various strength enhancement methods have been proposed.

In a side body with a flat plate fixed to the outer surface of the skeleton member, the stress at the corner portion is reduced by adding a thick plate to the corner portion of the openings such as windows and the like provided to the side body, or by enlarging the radius of the circular arc at the corner portion thereof.

In a side body constituted from arranging the extruded stocks in the longitudinal direction of the car body, the plate thickness of the face plates of the extruded stocks at the window region is thickened. The face plates of the extruded stocks from the upper portion of the window to the lower portion of the window is thickened. Moreover, as another embodiment, only the plate thickness of the region corresponding to window corner portion is thickened, and the plate thickness of the central portion is thinned, aiming at weight reduction (Japanese Patent Publication No. H6-45341).

A side body using hollow shape extruded stocks constituted from two face plates and ribs (Japanese Patent Laid-Open No. 2-246863) is designed under the idea similar to that mentioned above. Moreover, enhancement in strength is planned from the plate thickness of the face plates and the pitch of the ribs.

There are cases where plates are welded to the end portions of hollow shape extruded stocks constituting the region between the windows. The plates are positioned between the face plate of the hollow shape extruded stock at the inner side of the car and the face plate at the outer side of the car (Japanese Patent Laid-Open No. H7-257371).

SUMMARY OF THE INVENTION

With the prior art, enhancement in strength in the side body using the hollow shape stocks is planned from enlarging the radius at the corner portion, and from the plate thickness of the face plate and the pitch of the ribs. However, the prior art is insufficient in advancing weight reduction and strength enhancement further simultaneously.

The object of the present invention is to provide a car body achieving weight reduction and strength improvement.

In order to solve the above-mentioned object, the first method of the present invention includes;

plate thickness of face plates of the extruded stock at regions in the upper and lower area based on the connection points between the vertical sides of the window and the circular arcs of the corner portion of the window, respectively, being thicker than the plate thickness of face plates of the extruded stocks at upper and lower locations from the regions; and plate thickness of the face plates between the region having thicker plate thickness based on the connection point at upper portion of the window, and the region having thicker plate thickness based on the connection point at lower portion of the window, being thinner than plate thickness of the region having thicker plate thickness.

As the second method, the present invention arranges a buckling preventive tool in the space surrounded by the face plate and the ribs, to the hollow shape stock constituting the neighborhood of the corner portion of the opening. This technique could be applied to openings other than windows.

As the third method, the present invention thickens the thickness of the face plate at the inner side of the car of the hollow shape stock constituting the side body more than the thickness of the face plate at the outer side of the car.

MODE FOR CARRYING OUT THE INVENTION

Figure 1:
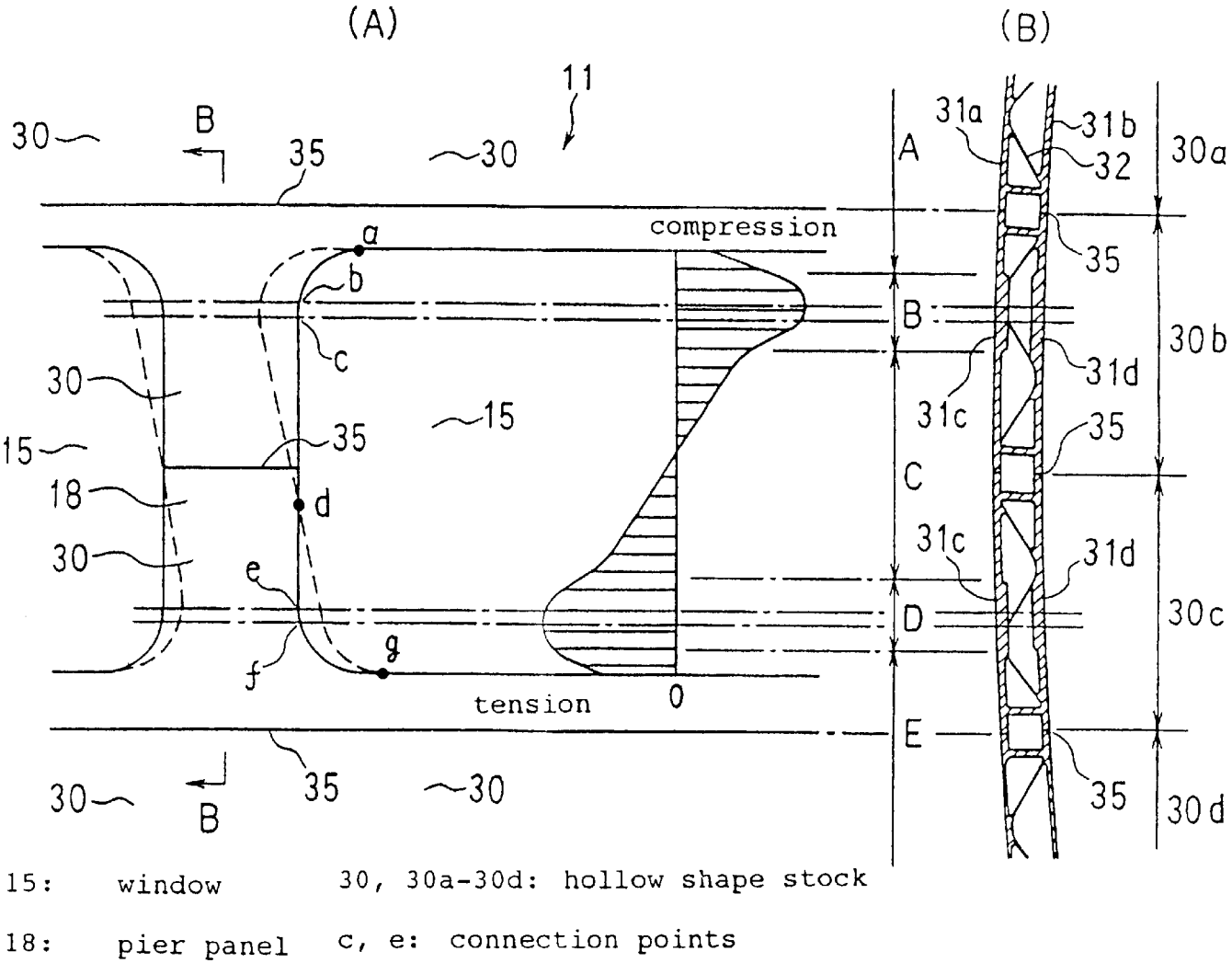
FIG. 1 is a side view and longitudinal cross-sectional view of a side body according to an embodiment of the present invention.

An embodiment of the present invention will be explained below referring to FIG. 1 through FIG. 3. In FIG. 3, a car body 10 of a railway car is constituted from side bodies 11 forming the left and right surfaces in the longitudinal direction of the car body, end bodies 12 forming the surfaces closing both ends in the longitudinal direction of the car body, a roof body 13 forming the roof, and an underframe 14 forming the floor.

The side body 11 is provided with openings such as windows 15 or entrances 16. The side body 11 includes upper and lower portions of the window 15, and the upper portion of the entrance 16. The region between the window 15 and the window 15 is called a pier panel 18. The side body 11 between the entrance 16 and the entrance 16 is constituted using plural extruded stocks made of light alloy. The roof body 13 and the under frame 15 are also constituted using plural extruded stocks made of light alloy.

Figure 2:
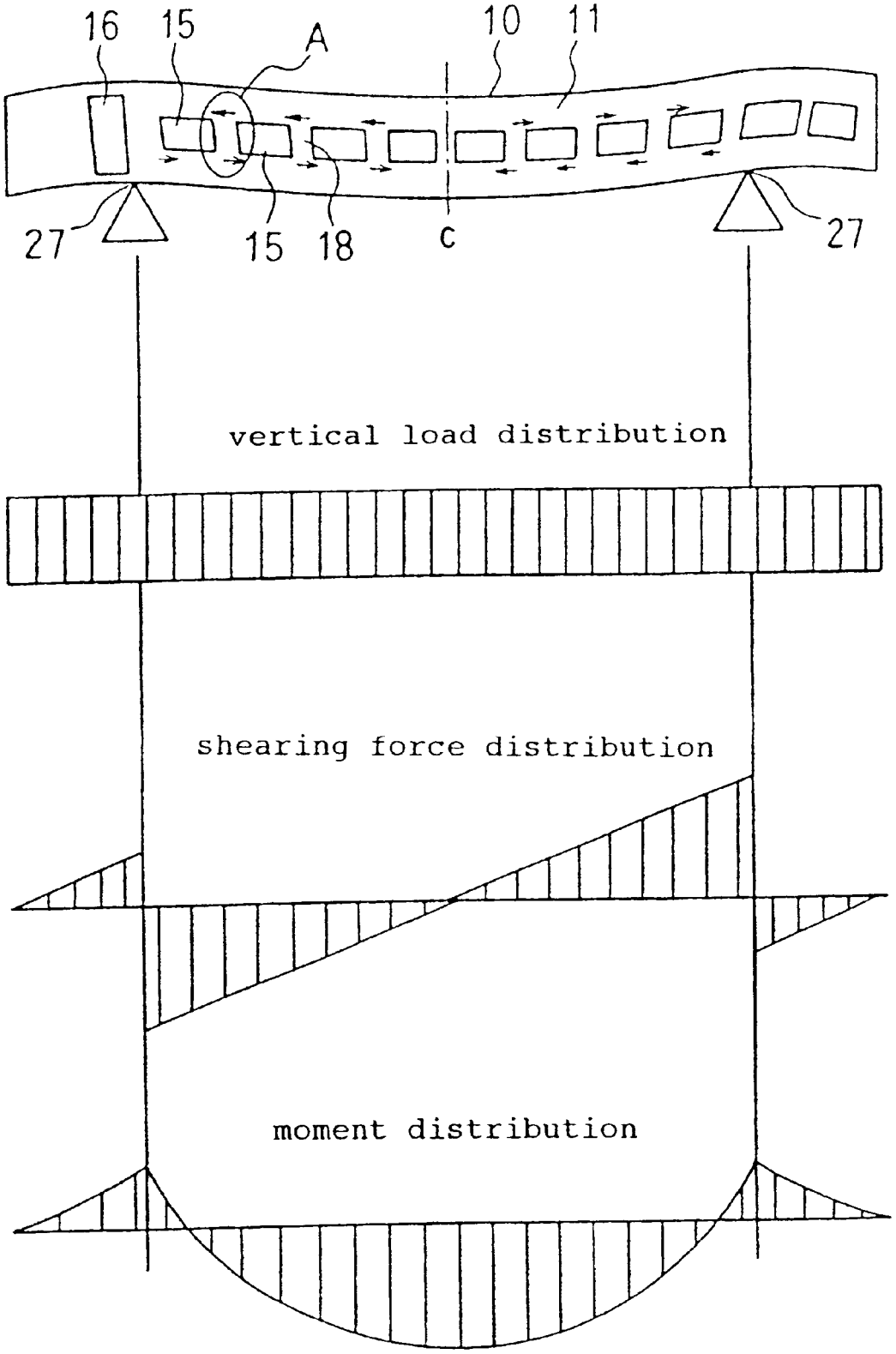
FIG. 2 is an explanatory view of the load, shearing force, and bending moment operating on the car body.
Figure 3:
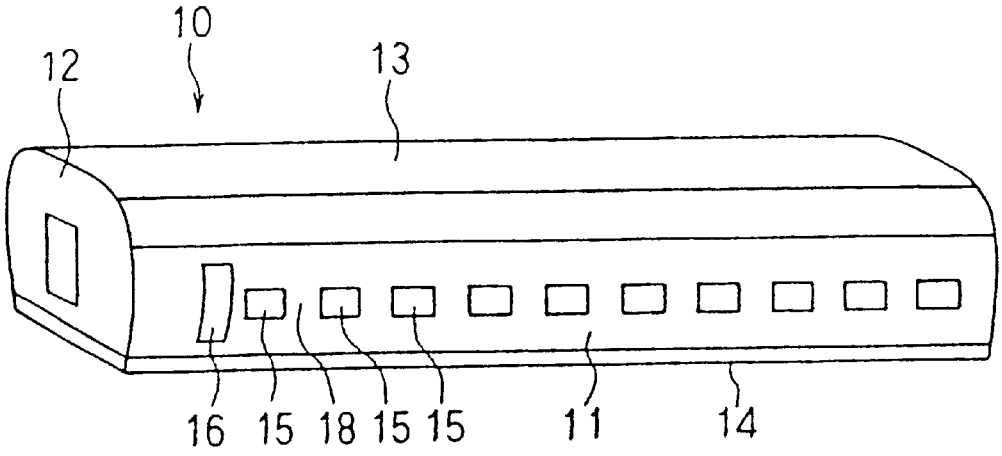
FIG. 3 is a perspective view of the car body of a railway car.

FIG. 2 schematically shows the load distribution, shearing force distribution, bending moment distribution, and deformation of the car body 10, in the case where vertical loads such as deadweight of the car body 10, electric wires, seats, electric equipments such as transformer, and passengers and the like operate on the car body 10. The car body is supported at supporting points 27 by a bogie. The vertical load is distributed approximately uniformly in the longitudinal direction of the car body and in the width direction of the car body. As a result, the distribution in the longitudinal direction of the car body 10 generates large bending moment at the center thereof, so that large shearing force is generated at the neighborhood of the bogie supporting point 27. The shearing force is equal to none at the center in the longitudinal direction of the car body, and is distributed so as to maximize at the neighborhood of the bogie supporting point 27.

Next, the distribution of the shearing force at an optional cross section of the car body 10 in the longitudinal direction of the car body will be considered. When a uniform load is loaded on a beam in the meaning of strength of materials, it is well known that the shearing strength is distributed most heavily on the neutral axis. In the case where the car body 10 is regarded as a beam in the meaning of strength of materials, the position of the pier panel becomes the position corresponding to the neutral axis. That is, when the vertical load operates on the car body 10, the highest shearing force in an optional cross section of the car body 10 in the longitudinal direction of the car body generates at the pier panel 18.

The reference (A) in FIG. 1 is an enlarged view of the pier panel 18 of the region A in FIG. 2, and the stress distribution at points a, b, c, d, e, f, g of the right side of the pier panel 18. The reference (B) of FIG. 1 shows the cross section of the reference (A) in FIG. 1 taken along line B—B. The height position of (A) in FIG. 1 and the height position of (B) in FIG. 1 are equal.

The position interposed between two adjacent windows 15, 15 is called the pier panel 18. The window 15 is approximately quadrangle. The sides of the quadrangle are straight lines or curved lines having large radius of curvature so that it could be regarded as almost straight. Therefore, the four sides are substantially straight. The area corresponding to the corners of the quadrangle are circular arcs, with the radius of curvature being extremely smaller than that of the sides of the quadrangle.

The side body 11 is constituted from plural hollow shape extruded stocks made of light alloy (hereinafter referred to as hollow shape stocks) 30*a*, 30*b*, 30*c*, 30*d*. The extruded directions of the hollow shape stocks 30*a* through 30*d* are positioned in the longitudinal direction of the car body 10. The end portions of the hollow shape stocks 30*a* through 30*d* are welded at the outer side of the car and the inner side of the car, respectively. Reference number 35 denotes the welded position. The window 15 is constituted by forming a hole to the hollow shape stocks 30*b*, 30*c*. The upper side of the window 15 is comprised of the hollow shape stock 30*b*. The lower side of the window 15 is comprised of the hollow shape stock 30*c*. The roof body 13 is welded to the upper side of the hollow shape stock 30*a* constituting the upper side of the side body 11. The underframe 14 is welded to the lower side of the hollow shape stock 30*d* constituting the lower side of the side body 11.

The hollow shape stocks 30*a* through 30*d* will be referred to as a whole as the hollow shape stock 30. The hollow shape stock 30 is composed of two face plates 31*a*, 31*b*, and a plurality of ribs 32 connecting the face plates 31*a*, 31*b* in stagger (in truss-shape). The face plate 31*a* constitutes the outer side of the car, and the face plate 31*b* constitutes the inner side of the car. The face plates 31*a* and 31*b* are referred to as a whole as the face plate 31. No post exists at the inner side of the car from the face plate 31*b*.

The deformation of the pier plate 18 will be examined. In reference (A) of FIG. 1, the upper portion of the window 15 tends to move to the left side of the drawing, and the lower portion of the window 15 on the other hand tends to move to the right side of the drawing. This movement is shown by the dotted lines. This movement is reversed at the axis at the center of the car body 10 in the longitudinal direction. Therefore, in FIG. 3, at the left half of the car body 10 in the longitudinal direction (the reference (A) in FIG. 1), compressive stress is generated at the upper portion side of the right side of the pier plate 18, and tensile stress is generated at the lower portion side thereof. This is as is indicated in the stress distribution diagram for the right side of reference (A) in FIG. 1. At the left side of the pier plate 18 of reference (A) in FIG. 1, tensile stress is generated at the upper portion side, and compressive stress is generated at the lower portion side. This is reversed at the right half of the car body 10.

The generation of the above-mentioned stress is approximately none at point d at the center of span in the height direction of the pier plate 18, and is gradually increased as it becomes closer to the supporting point (point a being the joint point with the upper side of the window 15, and point g being the joint point with the lower side of the window 15). Moreover, the stress concentrates at the corner portion, so that the stress becomes stronger. This is mentioned in pages 38 through 42 of the Light Metal Vehicle Committee Report No. 4 (Japan Society of Railway Car Manufacturers, Light Metal Association, published 1984).

Next, the stress distribution relative to the height direction of the pier plate 18 will be examined. At the central portion in the height direction, stress with equal gradient is distributed. The absolute value of the stress becomes drastically high at the neighborhood of the supporting point (point a being the joint point with the upper side of the window 15, and point g being the joint point with the lower side of the window 15), generating stress concentration. As is seen from above, shearing force distributing in the longitudinal direction of the car body 10 operates as a load for bending the pier plate 18. The load for bending the pier plate 18 stands for a condition of combined bending moment and shearing force. Especially, bending moment has a large influence. The regions with heaviest concentration of stress and largest generated stress, in the case where bending moment operates as is mentioned above to a structure having a shape similar to the corner portion, are the neighborhood of the connection points c, e between the straight side of the pier plate 18 and the circular arc of the corner portion, as is shown in FIG. 2.

This is publicly known in the field of strength of materials. For example, the regions with the heaviest concentration of stress in Stress Concentration (by Masataka Nishida, Morikita Shuppan 1967; pages 637–639; 1967) are points b, f at slightly towards the circular arc side from the connection points c, e between the pier panel 18 and the arc at the corner portion, in the present case.

Now, the side body 11 will be divided into five regions starting from region A at the top to region E, at the pier panel 18. The regions B, D are the regions generating high stress, centering on points b, f at slightly towards the circular arc side from the starting end of the circular arc (circular arc toe end) (connection points c, e). The regions B, D are regions excluding the upper and lower sides of the window 18. The region A is the upper region from the region B. The region E is the lower region from the region D. The region C is positioned between the region B and region D.

The height positions of the plurality of windows 15 provided to the side body 11 are equal. Therefore, the positions of the region A through region E in the height direction are equal for every window 15. The thickness of the hollow shape stocks 30*a*, 30*b*, 30*c*, 30*d* constituting the side body 11 are equal. The face plates existing at region B and region D will be called 31*c*, 31*d*. The thickness of the face plates 31*c*, 31*d* are thicker than that of the face plates 31*a*, 31*b*. The thickness of the face plates 31*a*, 31*b* of the hollow shape stocks 30*a*, 30*b*, 30*c* are thicker than that of the face plate of the hollow shape stock 30*d*.

In such composition, the thickness of the face plate of hollow shape stock 30 at regions B, D centering on points b, f at the corner portion with the heaviest concentration of stress is thickened, so that stress could be reduced efficiently, and enhancement in strength could be obtained. Moreover, the regions with thickened face plates are limited to regions B, D centering on points b, f with the heaviest concentration of stress, so that the thickened region could be minimized, achieving reduction in weight.

Furthermore, under examination from the view point of manufacturing, the hollow shape stocks 30 constituting the side body 11 have their extruded directions toward the longitudinal direction of the car body, so that even in the case where the plate thickness of the face plates of region B and region D are changed for all the windows 15, only the shape of the die for manufacturing the hollow shape stocks 30 should be changed. Therefore, the size change could be performed uniformly with ease for all the windows 15.

In the above-mentioned embodiment, there are cases where the plate thickness of the face plate of one of the hollow shape stock and that of the rib differ extremely. In such case, the plate thickness of the rib is thin compared to that of the face plate, so that disadvantage in manufacturing, such as metal being extruded only to the face plates having little extrusion resistance and no metal being provided to the rib, might occur.

Figure 4:
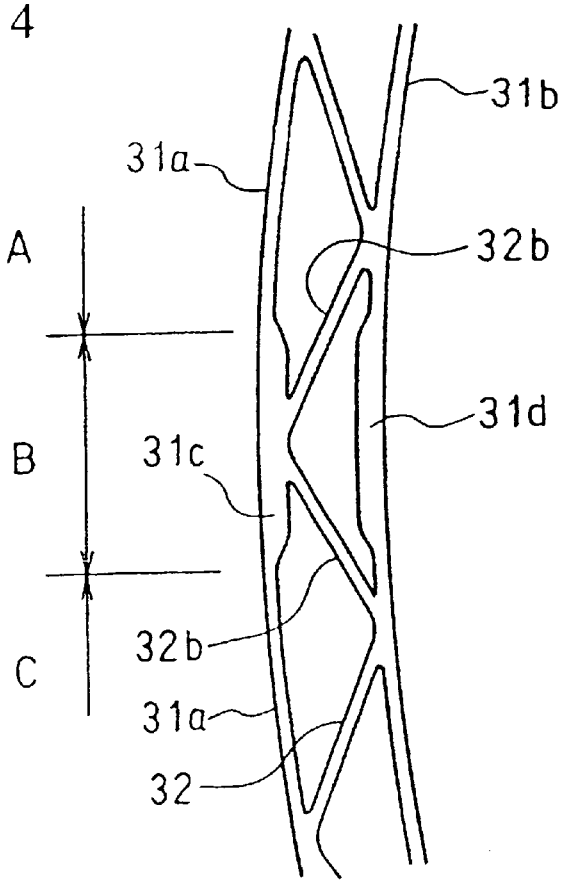
FIG. 4 is a longitudinal cross-sectional view of a feature of the side body according to another embodiment of the present invention.
Figure 5:
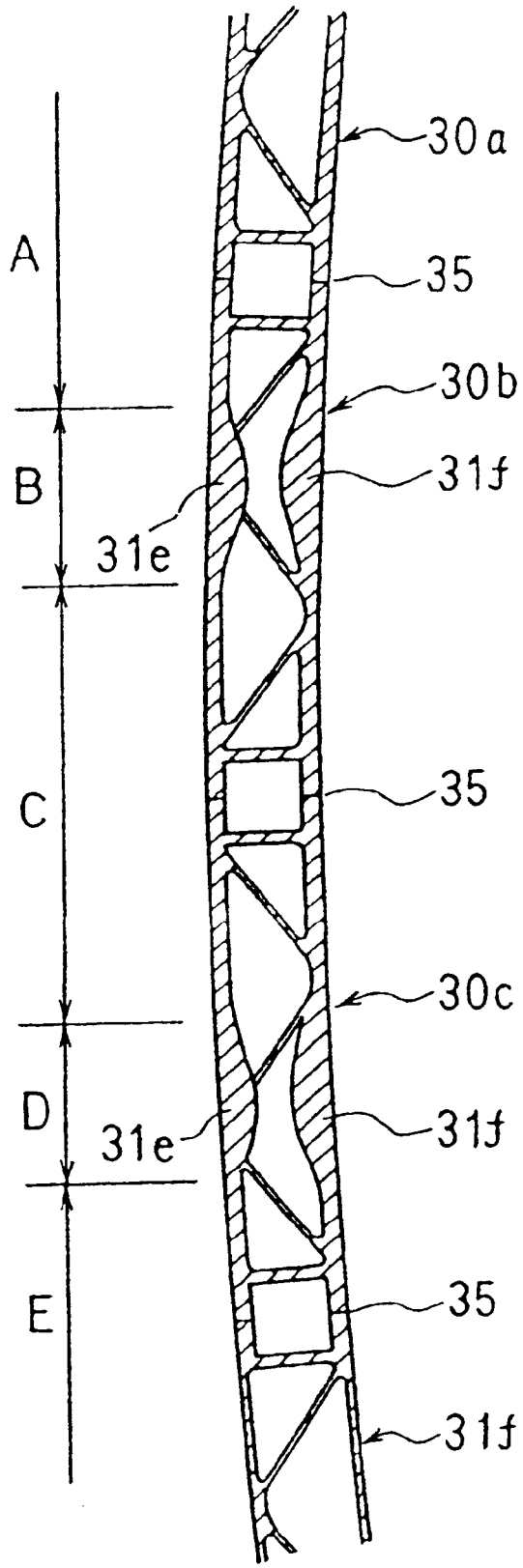
FIG. 5 is a longitudinal cross-sectional view of the side body according to another embodiment of the present invention.
Figure 6:
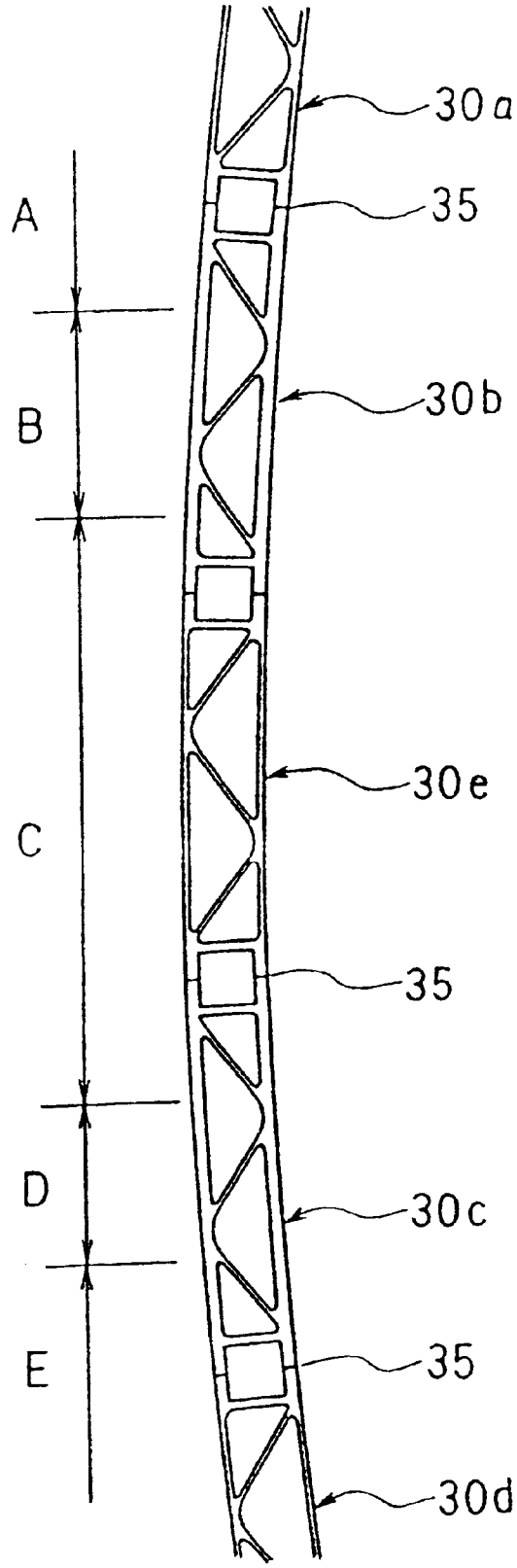
FIG. 6 is a longitudinal cross-sectional view of the side body according to another embodiment of the present invention.

The embodiment shown in FIG. 4 prevents such disadvantage. FIG. 5 corresponds to reference (B) in FIG. 1. The main structure is the same as that of the embodiment in FIG. 1. The plate thickness of the rib 32*b*connecting to the face plate 31 of the region B (D) is thicker than that of the ribs 32 connecting to the face plates 31*a*, 31*b* in the other regions A, C (D).

With such structure, the plate thickness of the rib 32*b* connecting to the thickened face plate 31*c* is thickened, so that the extrusion resistance of the two will not differ greatly, solving the problem on manufacturing.

The embodiment shown in FIG. 5 will be explained. FIG. 5 corresponds to reference (B) in FIG. 1. The main structure is the same as that of the embodiment in FIG. 1. The face plates 31*e*, 31*f* of the regions B, D are convex arcuate towards the inner side of the hollow shape stock. The region B is thinned gradually towards the regions A, C (towards the end of the corner portion in the height direction). The region D is thinned gradually towards the regions C, E. The position with the heaviest concentration of stress is thickened the most. With such structure, further reduction in mass could be achieved compared to the embodiment shown in FIG. 1.

The main structure is the same as the embodiment in FIG. 1. The dissimilarity from FIG. 1 will be indicated hereinafter. The thickness of the face plates of the regions B, D are not thickened. The thickness of the face plates of the regions B, D are the same as the thickness of the face plates in the other regions A, C, D. A buckling preventive tool 50 is arranged in the space (cell) surrounded by the face plate 31 of the hollow shape stock 30 and the two inclined ribs 32, 32, at the pier plate 18 of the corner portion in the horizontal direction. The spaces (cells) arranged with the buckling preventive tool 50 are the spaces (cell) where the regions B, D are located. The buckling preventive tool 50 is planar, with its plane installed to be in the vertical direction relative to the extruded direction of the hollow shape stock 30. The buckling preventive tool 50 is inserted to the above-mentioned space from the window 15. The buckling preventive tool 50 is in contact with the face plate 31 and the ribs 32, 32. The buckling preventive tool 50 is fixed to the face plate 31 and the ribs 32, 32 by welding or adhering. It should only be fixed to the extent that the buckling preventive tool 50 does not easily move in the longitudinal direction of the car body. The contact point between the plate of the buckling preventive tool 50 and the face plate 31 and the ribs 32, 32 should not necessarily be the whole area of the face plate 31 and the ribs 32, 32, and should contact at the position enabling easy buckling.

As is shown in FIG. 1, the corner portion is loaded with high compressive stress. When the compressive stress is loaded, there is a fear that elastic buckling might occur at the face plate 31 or the ribs 32, 32.

Figure 7:
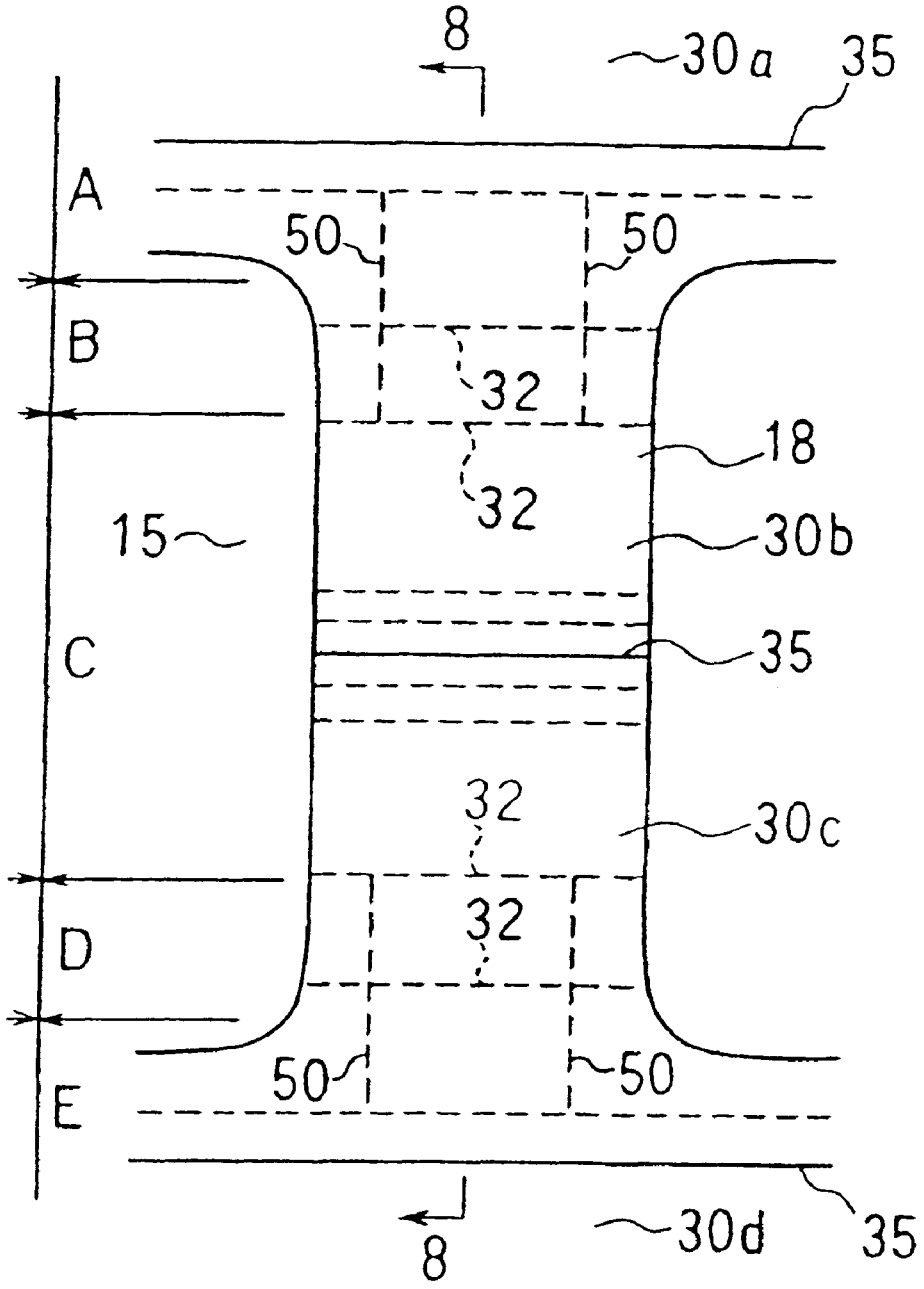
FIG. 7 is a side view of the side body according to another embodiment of the present invention.
Figure 8:
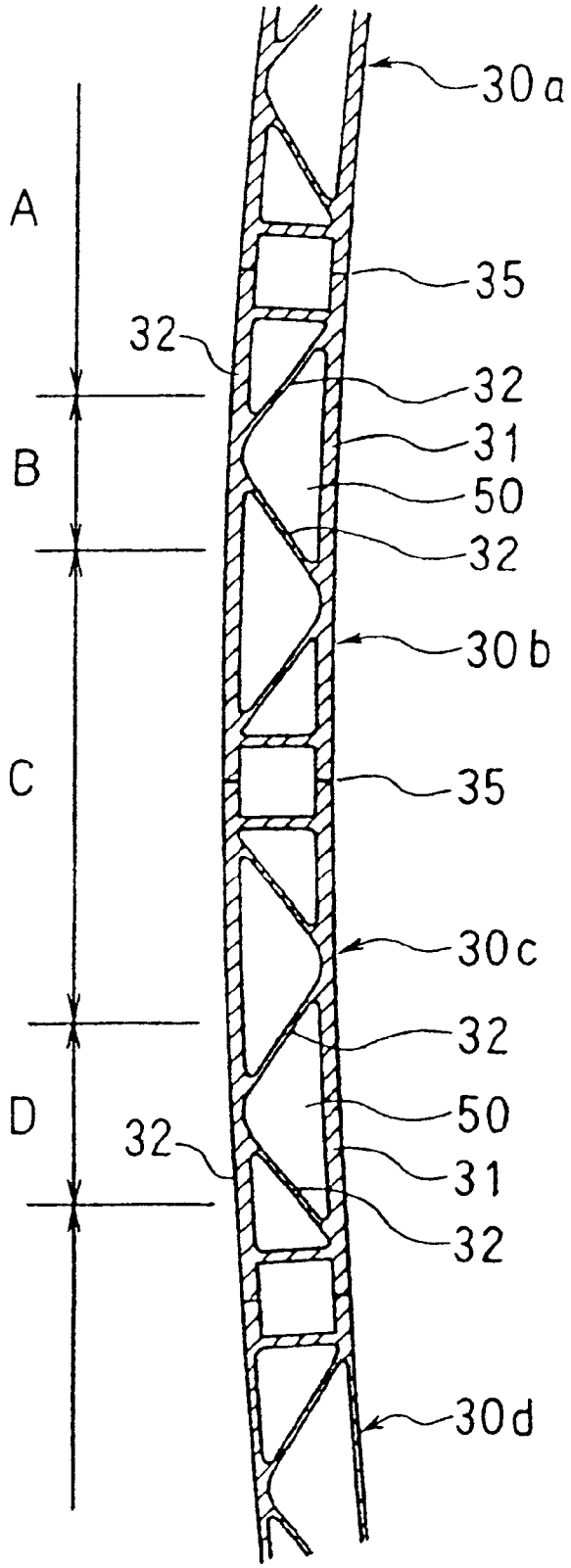
FIG. 8 is a cross-sectional view taken along line 8—8 in FIG. 7.

In the embodiment shown in FIG. 7 and FIG. 8, the planar buckling preventive tool 50 constrains the region where buckling might occur. Therefore, the buckling limit stress of the face plate 31 and the ribs 32, 32 could be improved with ease, and the strength could be enhanced. Moreover, there is no need for the plate thickness to be increased for the whole length in the longitudinal direction of the car body 10, so that reduction in weight could be advanced.

It is impossible to specify which side of the plane in the normal direction is bent from buckling. However, in the case where the face plate 31 or the rib 32 of the hollow shape stock 30 buckles and bends, the rib 32 and the face plate 32 adjacent to the buckled member bends also. Then, as is in the present embodiment, deformation could be inhibited regardless of the direction of bending from buckling, by installing the buckling preventive tool 50 so as to contact the face plate 31 and ribs 32, 32. Therefore, the buckling limit stress is improved extremely regardless of the direction of bending from buckling deformation, so that the strength is enhanced.

The buckling preventive tool 50 is preferably located toward the central side of the pier plate 18, rather than at the neighborhood of the window 15.

The buckling preventive tool 50 may be arranged to all of the plurality of windows 15 existing on the side body 11. However, by providing the tool only to the corner portion where it is necessary, further reduction in weight could be achieved.

Moreover, though the buckling preventive tool 50 is arranged on all four corner portions of the pier panel 18 in FIG. 7, it may be arranged only to the region where the compressive stress occurs. For example, in the case of region A in FIG. 2 (reference (A) in FIG. 1), the buckling preventive tool 50 is unnecessary at the lower right and upper left corner portions in FIG. 7.

When welding is used as the fixing means of the buckling preventive tool 50, the harm from its heat becomes a problem. When fixing using an adhesive, the buckling preventive tool being slightly elongated in the longitudinal direction of the car body should be used.

The spaces (cells) in the range of the regions B, D exist above and below the above-mentioned space. The buckling preventive tool is installed to these spaces 50*b*, 50*c* according to need. In the case where the buckling preventive tool is installed to the space 50*b*, it should be noted that this space 50*b* is a space manufactured by the extruded stock, and not a space constituted by connecting two extruded stocks by welding. Therefore, as is the case in FIG. 8, the shape of the space for installing the buckling preventive tool 50*b* is uniform, so that the buckling preventive tool 50*b* is in contact with the face plate and the ribs.

Figure 9:
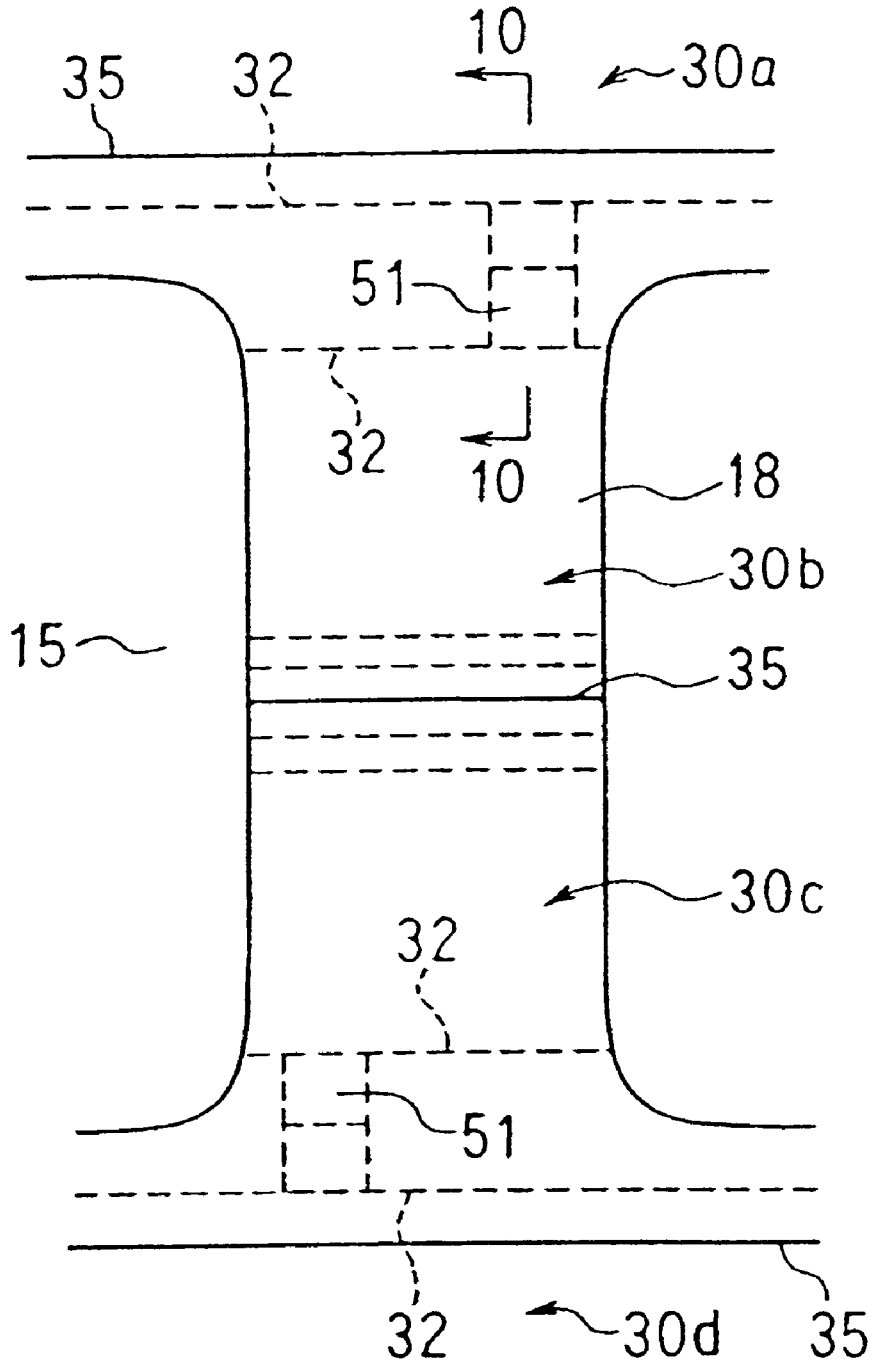
FIG. 9 is a side view of the side body according to another embodiment of the present invention.
Figure 10:
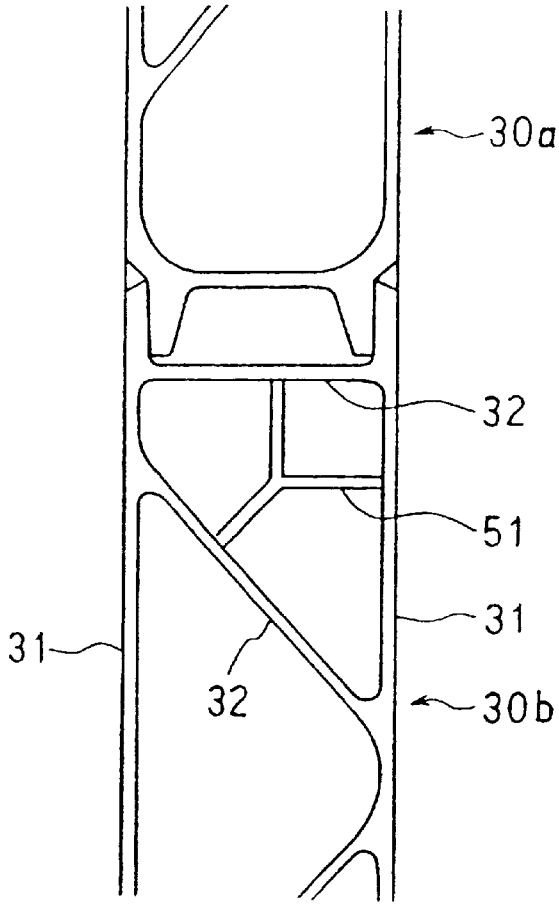
FIG. 10 is a cross-sectional view taken along line 10—10 in FIG. 9.
Figure 11:
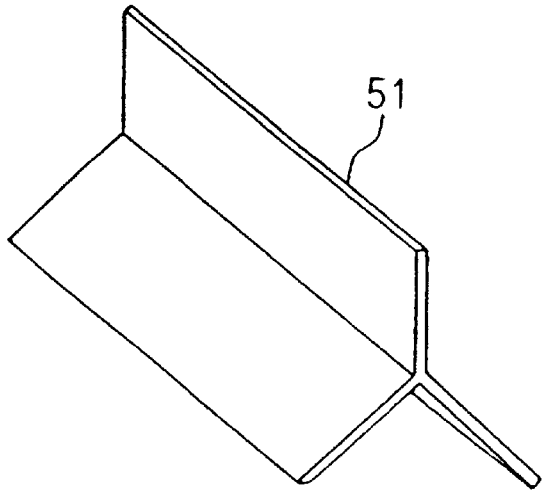
FIG. 11 is a perspective view of the buckling preventive tool in FIG. 10.

The embodiment shown in FIG. 9, FIG. 10 and FIG. 11 will be explained. The buckling preventive tool 51 has a length in the longitudinal direction of the car body. The buckling preventive tool 51 is trifurcate at the cross-section in the vertical direction relative to the longitudinal direction of the car body. Three blocks of the trifurcation 51 are elongated in the longitudinal direction of the car body. Three blocks are respectively in contact with the face plate 31, and the ribs 32, 32. The locations for installing the buckling preventive tools 51 are locations where the compressive stress operates, and not to locations where tensile stress operates. The location for installing the buckling preventive tools 51 should be locations corresponding to the regions B, D.

With such structure, the buckling deformation of the face plates and the ribs could be restrained, in a range elongated in the longitudinal direction of the car body. Therefore, the buckling limit stress of the face plates and the ribs may further be improved. Moreover, only a minimum increase in plate thickness is necessary in the case where high compressive stress is loaded to the corner portion, so that reduction in weight may be advanced. Furthermore, the buckling preventive tool 51 is in contact with the face plate and the ribs at the leading ends of the blocks, so that the two could be in contact with ease.

By using a material having high heat insulating ability or high vibration suppressing ability as the buckling preventive tool 51, the improvement in comfort of the passengers in the car may be achieved. The composition of FIG. 1 may be combined with the composition of buckling preventive tools 50, 50*a*, and 51.

Figure 12:
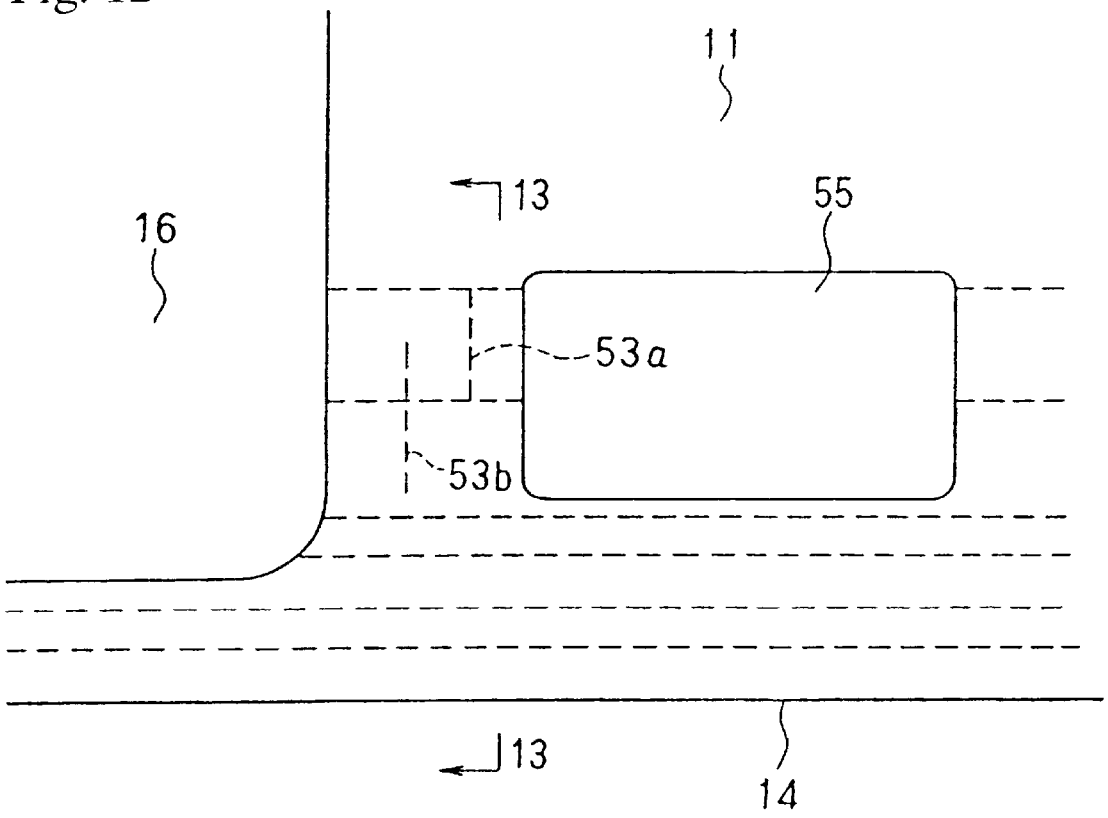
FIG. 12 is a side view of a feature of the side body according to another embodiment of the present invention.
Figure 13:
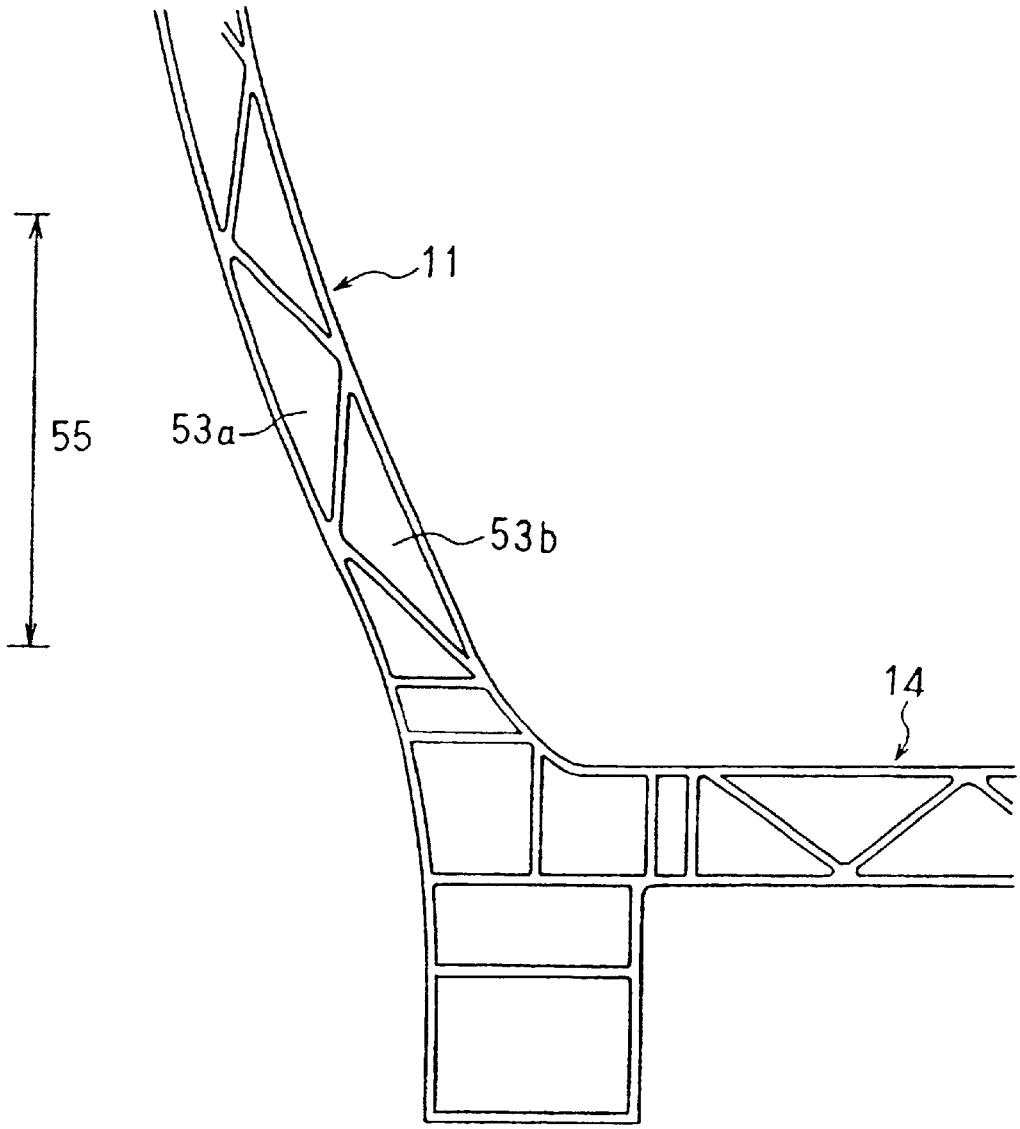
FIG. 13 is a cross-sectional view taken along line 13—13 in FIG. 12.

The embodiment in FIG. 12 and FIG. 13 will be explained. The openings on the side body 11 are not only windows 15 and entrances 16. FIG. 12 is an opening 55 provided to the neighborhood of the lower portion of the entrance 16. The opening 55 is provided for inspecting, cleaning or repairing the space for storing the trapdoor of the entrance 16. The opening 55 pierces the side body 11. The two openings 16, 55 are adjacent to each other, so that when the two openings 16, 55 are positioned in the neighborhood of the supporting point 27, there occurs considerably high compressive stress. In the aforementioned region, buckling must be prevented in a considerably wide area, compared to that of the corner portion of the window 15. In such case, a plurality of buckling preventive tools is arranged. The buckling preventive tools 53*a*, 53*b* are respectively inserted to two cells (comprised of two face plates and two ribs) of the side body 11 which the opening 55 pierces. The buckling preventive tools 53*a*, 53*b* are inserted from the side of the entrance 16. The welded region is omitted from the drawing in FIG. 13.

Moreover, to the upper portion of the window 15 and the entrance 16, there are provided openings for indicating the destination or the nickname of the vehicle. This technique may be applied to this opening also.

The above-mentioned embodiment is explained for application to the side body 11. However, it may also be applied to openings such as those provided to the underframe 14. On the underframe 14, the hollow shape stocks between the supporting points 27, 27 are arranged along the longitudinal direction of the car body. In this portion, openings are provided by notching one of the face plates, or by piercing in the vertical direction, in order to pass the wires and air pipings. To the neighborhood of the opening, the buckling preventive tool is arranged to the cell of the hollow shape stock.

Figure 14:
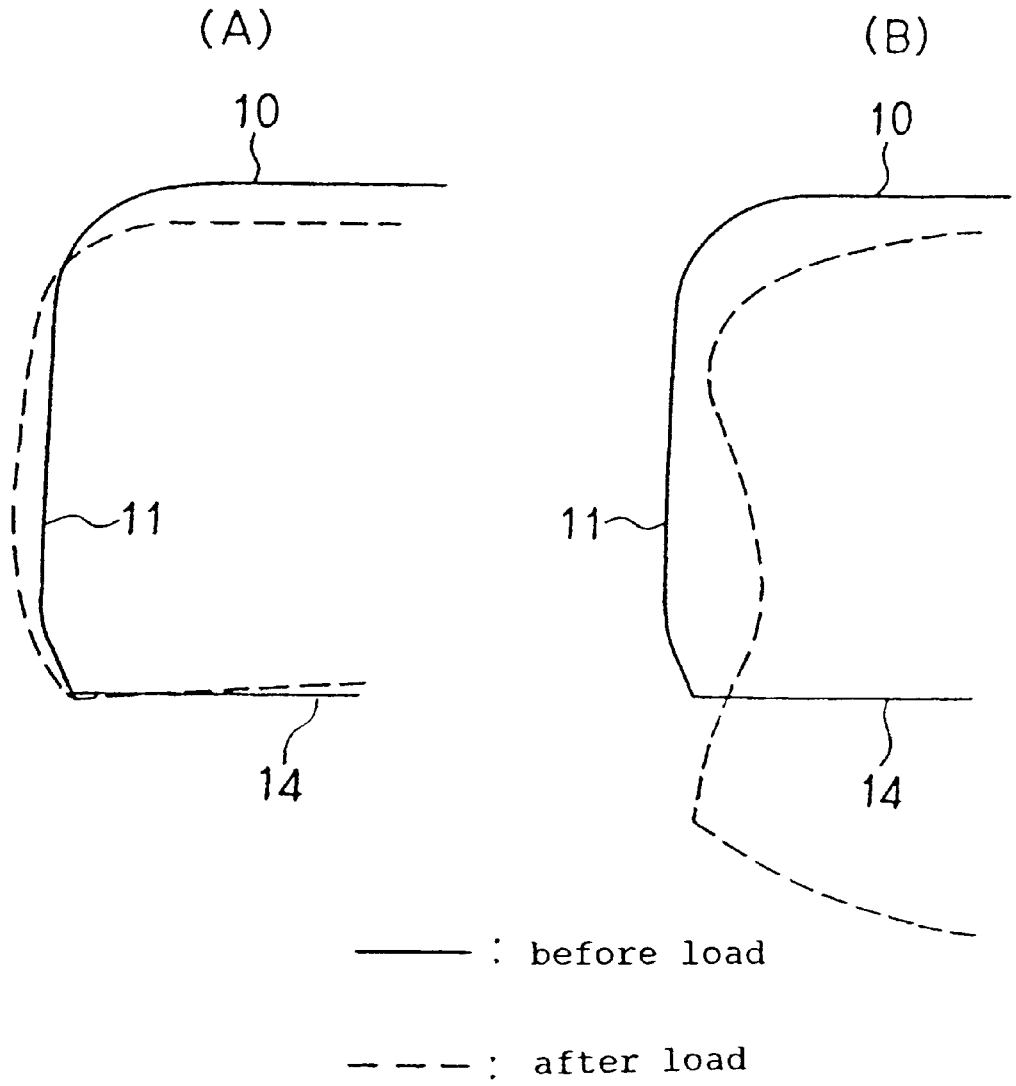
FIG. 14 is a deformation view of the car body of a railway car.

The embodiment of FIG. 14 and FIG. 15 will be explained. FIG. 14 shows the deformation in the cross-section in the width direction of the car body, when a vertical load operates on the car body 10. When a vertical load is loaded to the car body 10, the side body deforms as is shown in (A) of FIG. 15, in the neighborhood of the bogie supporting points 27 in the longitudinal direction of the car body. By this outward deformation, the stress other than the stress generated from shearing force as is shown in FIG. 2 generates at the pier panel 18, as is mentioned below. To the hollow shape stock 30 constituting the pier panel 18, tensile stress generates at the face plate at the outer side of the car, and compressive stress generates at the face plate at the inner side of the car.

Figure 15:
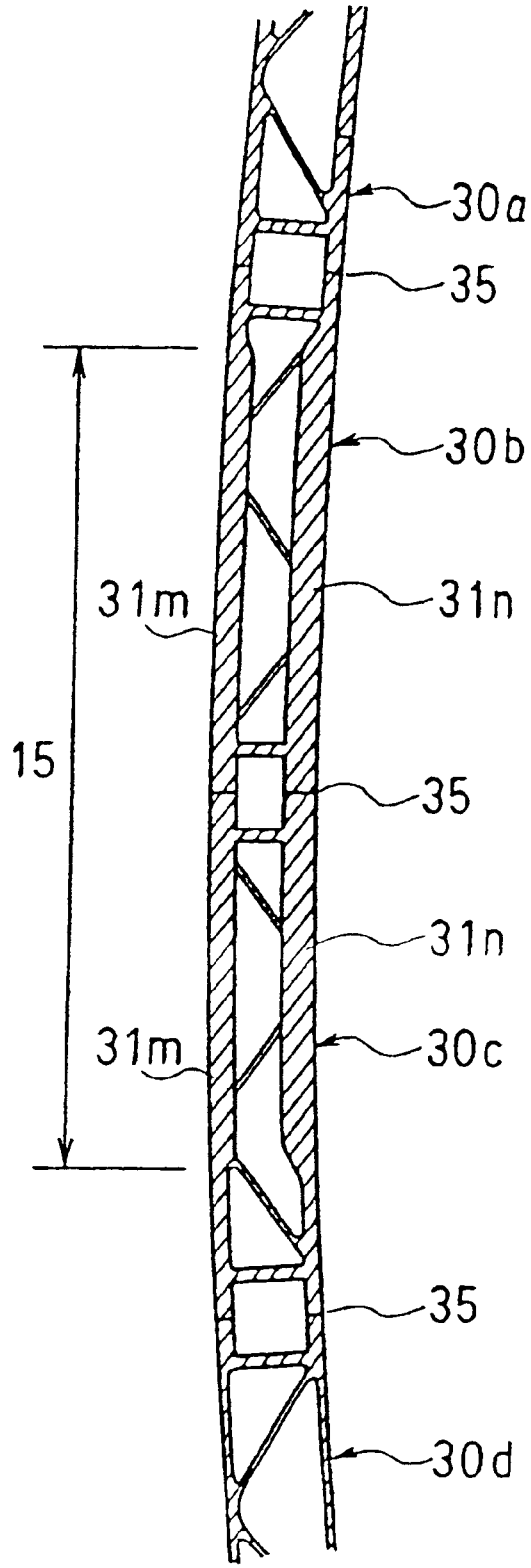
FIG. 15 is a cross-sectional view of the side body according to another embodiment of the present invention.

On the other hand, at the center in the longitudinal direction of the car body 10, the side body deforms as is shown in (B) of FIG. 15. Therefore, in addition to the shearing force shown in FIG. 2, tensile stress generates at the face plate 31*b* at the inner side of the car, and compressive stress generates at the face plate at the outer side of the car, to the hollow shape stock 30 constituting the pier panel 18, at the center in the longitudinal direction of the car body 10.

The absolute value of the outer deformation quantity at the center in the longitudinal direction of the car body and at the bogie supporting point 27 is larger at the center in the longitudinal direction of the car body. The stress originated from outer deformation of the side body is proportional to the outer deformation quantity, so that higher stress generates at the face plate at the inner side of the car than the face plate at the outer side of the car.

Among the plurality of hollow shape stocks 30*b*, 30*c* constituting the pier panel 18, the plate thickness of the face plate 31*m* at the outer side of the car and the face plate 31*n* at the inner side of the car at the region of the window 15 are thicker than the plate thickness of the other regions, in FIG. 15. The plate thickness of the face plate 31*n* at the inner side of the car is thicker than that of the face plate 31*m* at the outer side of the car.

With such structure, the maximum stress generated at the face plates of the hollow shape stock 30 constituting the pier panel 18 becomes approximately uniform, so that unnecessary mass may be reduced.

The embodiment of FIG. 15 may be combined with the embodiment of FIG. 1 and the buckling preventive tools 50, 50*a* and 51.

Figure 16:
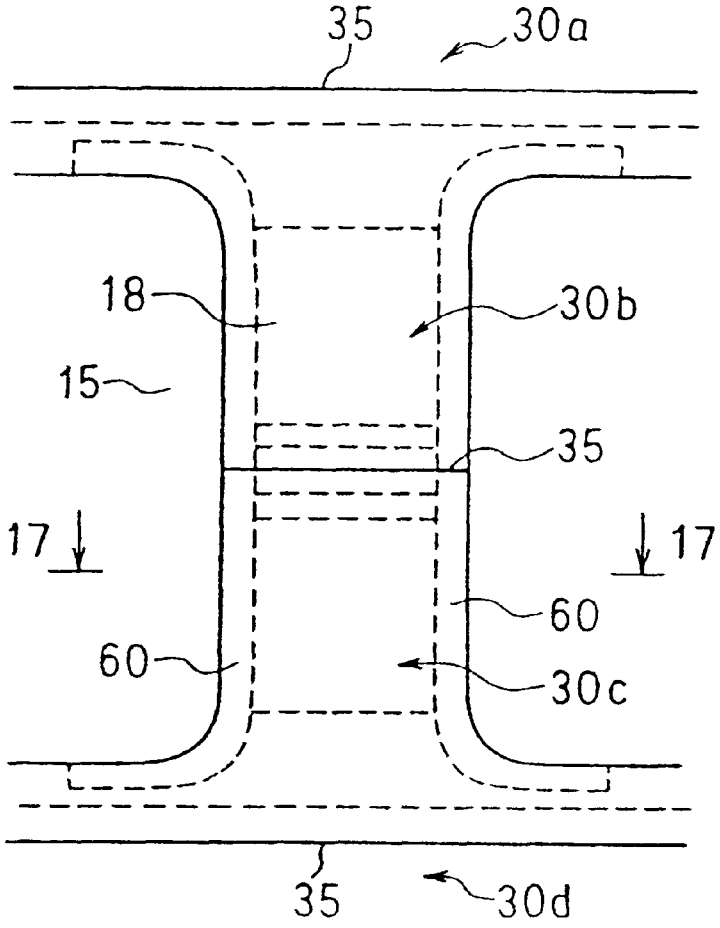
FIG. 16 is a side view of the side body according to another embodiment of the present invention.
Figure 17:
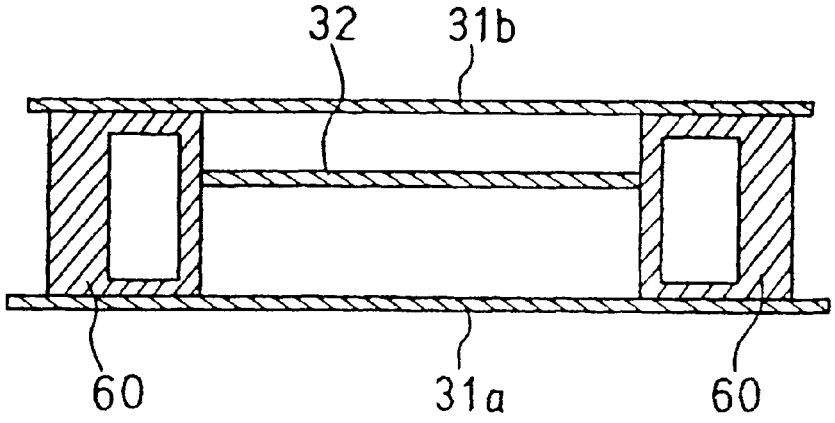
FIG. 17 is a cross-sectional view taken along line 17—17 in FIG. 16.

The embodiment shown in FIG. 16 and FIG. 17 will be explained. In FIG. 16, reinforcing members 60 are arranged to the side of the pier panel 18 in the vertical direction, and to the corner portions of the upper and lower sides of the window. The reinforcing member 60 includes the circular arc of the corner portion. The reinforcing member 60 is manufactured by bending a hollow shaped extruded stock. In FIG. 17, the reinforcing member 60 is arranged between the face plate 31*a* at the outer side of the car and the face plate 31*b* at the inner side of the car of the hollow shape stock 30. The rib 32 existing between the two face plates 31*a*, 31*b* is eliminated, so as to insert the reinforcing member 60. The reinforcing member 60 is welded to the face plates 31*a*, 31*b*.

With such structure, stress generated from bending moment originated at the pier panel 18 could be reduced. Moreover, stress subsequently generated at the corner portion could also be reduced. Furthermore, from the improvement in the rigidity of the pier panel 18, the deformation of the overall side body could be restrained, so that equivalent flexural rigidity of the railway rolling stock car body 10 is improved.

The embodiment of FIG. 16 and FIG. 17 could be combined with FIG. 14 and the buckling preventive tools 50, 51*a* and 51.

The technical scope of the present invention is not limited to the terms used in the claims or in the summary of the present invention, but is extended to the range in which a person skilled in the art could easily substitute based on the present disclosure.

According to the present invention, stresses could be reduced with minimized increase in mass, in a car body in which a hollow shape stock is used to form a side body and the like.

Industrial Applicability

What is claimed is:

1. A car body, including side bodies constituted using hollow shape stocks constituted from two face plates and a plurality of ribs connecting said face plates together;

said hollow shape stocks placed with extruded directions thereof arranged in the longitudinal direction of said car body; and a plurality of quadrangle windows formed to said hollow shape stocks along said longitudinal direction, wherein a plurality of buckling preventive tools is installed to a plurality of spaces surrounded by said face plate and two ribs of said hollow shape stocks only at locations in said longitudinal direction of corner portions of said windows, in a direction perpendicular relative to said longitudinal direction, with said buckling preventive tools being in contact with said face plate and said two ribs, and wherein said buckling preventive tools are installed only to said corner portions where compressive stress is generated.

2. A car body according to claim 1, wherein said buckling preventive tools are arranged in said spaces constituted from one of said hollow shape stocks.

* * * * *